United States Patent [19]

Bavisotto et al.

[11] 4,058,789

[45] Nov. 15, 1977

[54] ELECTRICAL CONNECTOR

[75] Inventors: Robert G. Bavisotto, Buffalo; John E. Reynolds, Kenmore; Robert S. Sbert, North Tonawanda, all of N.Y.

[73] Assignee: The Carborundum Company, Niagara Falls, N.Y.

[21] Appl. No.: 673,834

[22] Filed: Apr. 5, 1976

[51] Int. Cl.[2] ..... H01C 1/14

[52] U.S. Cl. ..... 338/322; 219/553; 338/329; 339/258 S

[58] Field of Search ..... 338/226, 322, 323, 324, 338/325, 326, 329, 331, 332, 62, 63, 20, 21; 219/552, 553; 339/258 S, 258 P, 258 R, 14 R; 361/262, 264, 266; 219/260, 267, 270, 541, 522

[56] References Cited

U.S. PATENT DOCUMENTS

| | | | |
|---|---|---|---|
| 1,970,051 | 8/1934 | McWeeny | 338/329 X |
| 3,046,381 | 7/1962 | Olswang | 219/270 |
| 3,307,136 | 2/1967 | Fitzer et al. | 338/322 |
| 3,611,275 | 10/1971 | Leddy et al. | 339/258 P |
| 3,680,031 | 7/1972 | Schomacher | 339/14 R |
| 3,842,319 | 10/1974 | Perl | 361/264 |
| 3,964,943 | 6/1976 | Andersen | 338/322 X |

OTHER PUBLICATIONS

C.Y. Liu, "Clip on Terminal Strip With Heat Sink," IBM Technical Disclosure Bulletin, vol. 16, No. 4, Sept. 1973.

*Primary Examiner*—C. L. Albritton
*Attorney, Agent, or Firm*—David E. Dougherty; Raymond W. Green; Michael L. Dunn

[57] ABSTRACT

An electrical connector comprising first, second and third legs, said legs being arranged to permit said second leg to be spacially separated by force from said first and third legs thus, permitting an electrical conductor to be placed between the second leg and the first and third legs and permitting said electrical conductor to be retained by said legs.

8 Claims, 7 Drawing Figures

ELECTRICAL CONNECTOR

BACKGROUND OF THE INVENTION

A. Field of the Invention

This invention concerns an electrical connector for interconnecting a plurality of electrical conductors. More particularly, the invention concerns an electrical connector for easily and securely connecting one electrical conductor such as wire or cable to another electrical conductor in the form of a flat or curved plate having a relatively large surface area when compared with its cross section.

B. History of the Prior Art

Prior art methods for connecting an electrical conductor such as a wire to another electrical conductor include soldering or welding the electrical conductors to one another or by securing the conductors together by means of various kinds of fasteners.

Welding or soldering electrical conductors together has certain disadvantages, in particular, forming a welded or soldered connection requires that high temperature be applied to the conductors in order to melt a metallic substance around the conductors. Particularly high temperatures are required when the conductors are welded together rather than soldered and welding is frequently required since soldering is suitable only when particular metals, such as copper, are used for the electrical conductors. In addition, welding and soldering often require that the electrical conductors be metal conductors and welding and soldering is usually not suitable for connecting non-metallic conductors.

Prior art fasteners for connecting electrical conductors are numerous. Examples of such fasteners are connecting nuts for twisting electrical wires together, screw type terminal posts and alligator clips. None of these prior art fasteners are, however, suitable for securely and rapidly forming an electrical connection with a conductor having a large surface area and a relatively small cross sectional area particularly where the conductor is brittle and non-metallic.

There is provided in the prior art an electrical connector which can be slipped over an electrical conductor having a large surface area relative to its cross sectional area; however, the connector is designed for conductors having only specific dimensions since the connector grips the edges of the conductor. In addition, such a prior art connector is not easily adapted for use with a brittle non-metallic electrical conductor since gripping the edges of such a conductor tends to cause the edges to crack.

BRIEF DESCRIPTION OF THE INVENTION

This invention is an electrical connector comprising first, second and third legs, the legs being arranged to permit the second leg to be spacially separated by force from the first and third legs thus permitting an electrical conductor to be placed between the second leg and the first and third legs and permitting the second electrical to be retained by the legs. The connector preferably further comprises a body portion to which a first electrical conductor, preferrably an electrical wire, may be attached by welding, soldering, a prior art electrical clip, or other suitable means. Desirably, the first, second and third legs outwardly extend in essentially the same direction from the body portion. Each of the legs is defined by front and rear faces and right and left edges. The second of the legs is disposed in a position approximately between the first and third legs. The legs are oriented in a relationship with each other so that the right edge of the first leg is proximate to the left edge of the second leg, the right edge of the second leg is proximate to the left edge of the third leg and the left edge of the third leg and right edge of the third leg each face in approximately the opposite direction away from all portions of the electrical conductor. The legs are manufactured of a metallic material having spring resiliency which permits the second leg to be spacially separated by force from the first and third legs to permit an object such as a ceramic or other non-metallic second electrical conductor to be placed between the second and first and third legs thus permitting the object to be retained by the rear face of the second leg and the front faces of the first and third legs thus completing electrical contact between the legs of the electrical connector and the retained object. The novel electrical connector can be readily connected with a brittle object with which electrical contact is to be made and can also be readily removed from such an object. In addition, the electrical connector of the invention can be easily and inexpensively manufactured and can be quickly and easily connected with a brittle object such as a non-metallic electrical conductor.

The invention further comprises the above electrical connector permanently assembled with a brittle electrical conductor such as a silcon carbide heating element.

DETAILED DESCRIPTION OF THE INVENTION

Figures 1, 2, 3, 4, 5, 6, 7:
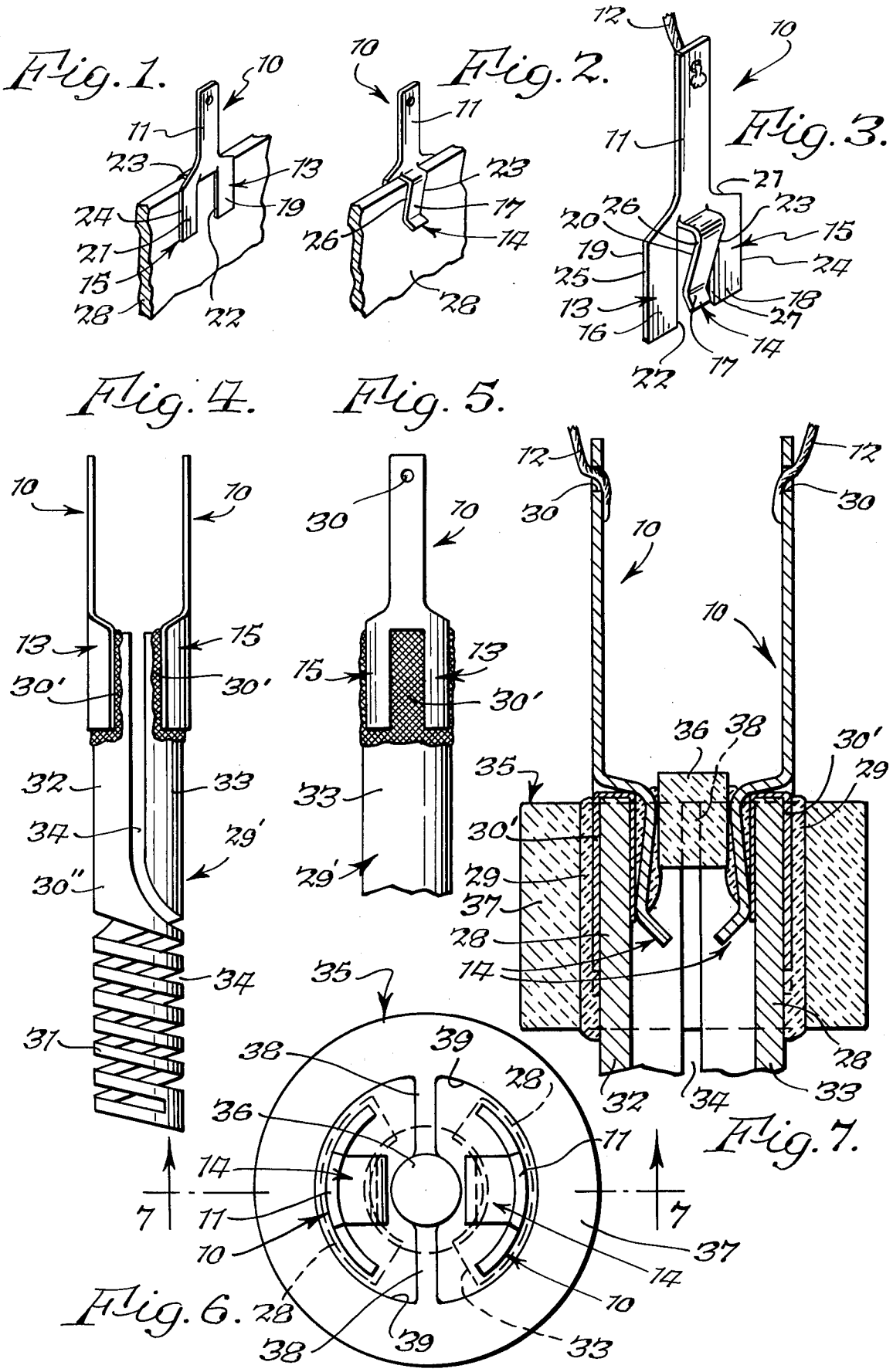
FIG. 1 is a perspective rear view of an electrical connector in accordance with the invention connected with an electrical conductor having planar front and rear surfaces.
FIG. 2 is a perspective front view of the connector of FIG. 1.
FIG. 3 is an enlarged perspective front view of the connector shown in FIG. 1 unconnected with an object.
FIG. 4 is a side elevational view of two electrical connectors in accordance with the invention which have curved front and rear surfaces, connected with a non-metallic electrical ignitor.
FIG. 5 is a partial rear view of one of the connectors shown in FIG. 4.
FIG. 6 is a top view of the connectors connected with the electrical ignitor as shown in FIG. 4
FIG. 7 is a sectional view taken on lines 7—7 of FIG. 6.

The electrically conductive material from which the electrical connector is manufactured is preferrably a metallic material which has a spring resiliency. Particularly suitable material are spring steel and other iron alloys which have sufficient memory to return to their original shape after deformation resulting from applying the connector to an electrical conductor. The electrical connector comprises a body portion and three legs extending therefrom. The body portion, preferrably though not necessarily, is in the shape of a flat metallic plate to which a first electrical conductor may be attached by welding, soldering an electrical clip or other suitable means.

The first, second and third legs extend in essentially the same direction from the body portion and each of the legs is defined by front and rear faces and right and left edges. The first and third legs have either arcuate or flat faces. When the first and third legs have flat faces, the faces are preferrably in the same plane and when the first and third legs have arcuate faces, the faces can preferrably be imposed upon the surface of the same cylinder. The second of the legs is disposed in a position approximately between the first and third legs and may be spacially separated by force from the first and third legs to permit a second electrical conductor to be placed between the second leg and the first and third legs. When the separating force applied to the second leg is released, the rear face of the second leg moves against the second electrical conductor due to its spring resiliency and forces the second electrical conductor against the front faces of the first and third legs. The first, second and third legs are relatively oriented so the right edge of the first leg is proximate the left edge of the second leg, the right edge of the second leg is proximate the left edge of the third leg and the left edge of the first leg and right edge of the third leg each face in approximately opposite directions away from all portions of the electrical conductor.

When the electrical connector of the invention is placed or clipped over the second electrical conductor, it may be permanently cemented or glued to the second electrical conductor by any suitable substance such as a ceramic paste. Since no welding is required to form a connection between the electrical connector and the second electrical conductor, and since the electrical connector does not grip the edges of the second electrical conductor, the second electrical conductor may be a brittle material such as silicon carbide.

In a preferred embodiment of the invention, the second electrical conductor is a heating element manufactured from a non-metallic material such as silicon carbide which element has two ends each of which is connected with an electrical connector as previously described. The heating element may comprise an elongated silicon carbide body having a high resistance central portion and low resistance end portions. The high resistance central portion being curved to permit the low resistance portions to be proximate to and spaced from each other. In a preferred embodiment of the invention, the spaced low resistance portions define a hollow cylinder. An insulating ceramic piece having an internal circular plug portion, an external cylindrical portion and a pair of shims supporting the plug and joining the plug with an interior surface of the external cylindrical portion may be provided and properly sized to support the above described hollow cylinder. In providing such support, the plug of the insulating ceramic piece fits within the hollow portion of the cylinder defined by the low resistance portions of the heating element, the external hollow cylindrical portion fits over the hollow cylinder defined by the low resistance portions and the shims fit within the space between the low resistance portions. Permanent support may be provided by the insulating ceramic piece by securely cementing the piece to the low resistance portions to support and maintain the spaced relationship between the low resistance portions.

Referring now to the drawings, as best seen in FIG. 3, the electrical connector 10 of the invention comprises a body portion 11 to which a first electrical conductor 12 may be attached by welding, soldering, an electrical clip or other suitable means. Electrical connector 10 further comprises first, second and third legs 13, 14, and 15 outwardly extending in essentially the same direction from body portion 11. Each of the legs 13, 14, and 15 are defined by front faces 16, 17, and 18 respectively; rear faces 19, 20 and 21 respectively; right edges 22, 23, and 24 respectively; and left edges 25, 26, and 27 respectively.

Second leg 14 is disposed in a position approximately between first leg 13 and second leg 15. The legs are oriented so right edge 22 of first leg 13 is proximate left edge 26 of second leg 14, right edge 23 of second leg 14 is proximate left edge 27 of third leg 15 and left edge 25 of first leg 13 and right edge 24 of third leg 15 each face in approximately opposite directions away from all portions of electrical conductor 10. Legs 13, 14 and 15 and particularly second leg 14, are preferrably manufactured of a metallic material having a spring resiliency which permits the the second leg 14 to be spacially separated by force from first and third legs 13 and 15 to permit an electrical conductor 28 to be placed between second leg 14 and first and third legs 13 and 15 and permitting second electrical conductor 28 to be retained by rear face 20 of second leg 14 and front faces 16 and 18 of first and third legs 13 and 15.

As best seen in FIG. 7, electrical connector 10 may be clipped over and permanently cemented to second electrical conductor 28 by means of any suitable cement such as a ceramic cement 29. As seen in FIGS. 5 and 7, the electrical connector 10 may be provided with a hole 30 in the body 11 of the electrical connector to facilitate attaching first conductor 12 to connector 10. Second conductor 28 may be a heating element 29' as shown in FIG. 4. The heating element may be non-metallic in nature and as shown in FIGS. 4 and 5, may be provided with a thin metallic coating 30' such as aluminum to facilitate electrical connection of connector 10 to conductor (heating element) 29'. Heating element 29' comprises an elongated silicon carbide body 30'' having a high resistance central portion 31 and low resistance end portions 32 and 33. The high resistance central portion 31 may be curved to permit low resistance end portions 32 and 33 to be proximate to and spaced from each other. Spaced low resistance portions 32 and 33 may be curved to define a hollow cylindrical shape. When low resistance end portions 32 and 33 are curved, first and third legs 13 and 15 of electrical connector 10 are similarly curved to increase surface contact of legs 13 and 15 with low resistance portions 32 and 33 of heating element 29'.

When second electrical conductor 28 is a heating element 29' having low resistance curved end portions 32 and 33 which are proximate each other to define the hollow cylinder, an insulating ceramic piece 35 as seen in FIGS. 6 and 7, may be provided to secure electrical connector 10 to element 29'. Ceramic piece 35 comprises an internal circular plug portion 36, an external hollow cylindrical portion 37 and a pair of shims 38 supporting plug 36 and joining plug 36 with interior surface 39 of external cylindrical portion 37. Plug 36 is properly sized and disposed between low resistance end portions 32 and 33 so that plug 36 fits within the hollow of the cylinder defined by the low resistance portions. External hollow cylindrical portion 37 fits over the hollow cylinder defined by the low resistance end portions 32 and 33 and shims 38 fit within the space 34 between low resistance portions 32 and 33. Ceramic piece 35 may be securely cemented to low resistance portions 32 and 33 and attached connectors 10 by means of a ceramic cement 29 to maintain the space relationship between low resistance end portions 32 and 33 and to firmly secure connectors 10 to the low resistance end portions.

What is claimed is:

1. An electrical connector manufactured from an electrically conductive material which connector comprises a body portion to which a first electrical conductor may be attached by welding, soldering, an electrical clip or other suitable means; and first, second and third legs outwardly extending in essentially the same direction from said body portion, each of said legs being defined by front and rear faces and right and left edges, the second of said legs being disposed in a position approximately between said first and third legs, said legs being oriented so the right edge of said first leg is proximate the left edge of said second leg, the right edge of said second leg is proximate the left edge of said third leg and the left edge of said first leg and right edge of said third leg each face is approximately opposite directions away from all portions of said electrical connector, said legs being manufactured of a metallic material having a spring resiliency which permits said second leg to be spacially separated by force from said first and third legs thus permitting a second electrical conductor to be placed between said second leg and said first and third legs and permitting said second electrical conductor to be retained by the rear face of said second leg and the front faces of said first and third legs.

2. The electrical connector of claim 1 wherein said connector is clipped over and permanently cemented to a second electrical conductor.

3. The electrical connector of claim 2 wherein said second electrical conductor is silicon carbide.

4. A heating element having two ends, each of which is connected to an electrical connector as described in claim 1.

5. The heating element of claim 4 which comprises an elongated silicon carbide body having a high resistance central portion and low resistance end portions, said high resistance central portion being curved to permit said low resistance portions to be proximate to and spaced from each other.

6. The heating element of claim 5 wherein said proximate spaced low resistance portions define a hollow cylinder.

7. The heating element of claim 5 wherein an insulating ceramic piece; having an internal circular plug portion, an external hollow cylindrical portion and a pair of shims supporting said plug and joining said plug with an interior surface of said external cylindrical portion; is properly sized and disposed upon said element so said plug fits within the hollow portion of the cylinder defined by the low resistance portions of said heating element, the external hollow cylindrical portion fits over the hollow cylinder defined by the low resistance portions and said shims fit within the space between said low resistance portions.

8. The heating element of claim 7 wherein said ceramic piece is securely cemented to said low resistance portions to support and maintain the spaced relationship between said low resistance portions.

* * * * *